United States Patent [19]

Sing

[11] Patent Number: 4,747,168

[45] Date of Patent: May 31, 1988

[54] POOL RECOVERY APPARATUS

[76] Inventor: Peter Sing, 168-10 84th Ave., Jamaica Hill, N.Y. 11432

[21] Appl. No.: 883,381

[22] Filed: Jul. 8, 1986

[51] Int. Cl.[4] ..... E04H 3/19

[52] U.S. Cl. ..... 4/504

[58] Field of Search ..... 4/504; 340/539

[56] References Cited

U.S. PATENT DOCUMENTS

| | | | |
|---|---|---|---|
| 3,000,017 | 9/1961 | Skovira | 4/504 X |
| 3,046,566 | 7/1962 | Berman | 4/504 X |
| 3,086,219 | 4/1963 | Stafford | 4/504 X |
| 3,092,844 | 6/1963 | Burnson | 4/504 X |
| 4,523,178 | 6/1985 | Fulhorst | 340/539 X |
| 4,549,169 | 10/1985 | Moura et al. | 340/539 |
| 4,606,073 | 8/1986 | Moore | 340/539 X |

*Primary Examiner*—Charles E. Phillips

*Attorney, Agent, or Firm*—Nathaniel Altman

[57] ABSTRACT

A recovery apparatus in the form of a net that normally rests on a swimming pool bottom and automatically draws a swimmer in distress out of the pool water by rising to the top of the pool.

7 Claims, 3 Drawing Sheets

A1–A11: forward
constant speed
V = 2' per second

B1–B4: reversed V = 1.5' per sec.
B4–B6: forward V = 2' per sec.
B6–B8: forward + ΔV V = 4' per sec.
B8–B11: forward V = 2' per sec.

POOL RECOVERY APPARATUS

FIELD OF INVENTION

The present invention relates to recovery apparatus for pools and, more particularly, to apparatus for recovery objects, such as swimmers and bathers, quickly and safely from a pool.

DESCRIPTION OF PRIOR ART

Bathers and swimmers in trouble have relied in the past on splashing and shouting that they are in need of help. If noticed, they are thrown life saving jackets, floats, and/or ropes for rescue. However, in case of a heart attack, or cramps, the victim may not be able to shout for help, and notice as well as time is important for successful rescue. Also, quick physical help may not be available or competent.

The present invention seeks to provide pool recovery apparatus that avoids such troubles by, for example, rescuing a bather or swimmer in distress more quickly and efficiently than has been possible in the past. The invention also can be used to recover objects, such as toys, animals, and fish, from a pool.

SUMMARY OF THE INVENTION

In accordance with the present invention there is provided a signal sending device that is worn by a swimmer, which in case of distress is actuated to produce an electrical signal that is received by apparatus for automatically saving the swimmer.

The recovery apparatus comprises a net that normally rests on the bottom of a pool, for example, that automatically draws the swimmer in distress out of the pool, by operation of the apparatus that is remotely controlled by the distress signal.

The invention can be used to net any object animate as well as inanimate in a pool in a similar situation.

BRIEF DESCRIPTION OF THE DRAWINGS

The invention will now be described further, by way of example, by reference to the accompanying drawings, in which.

DESCRIPTION OF THE PREFERRED EMBODIMENT

Figure 1:
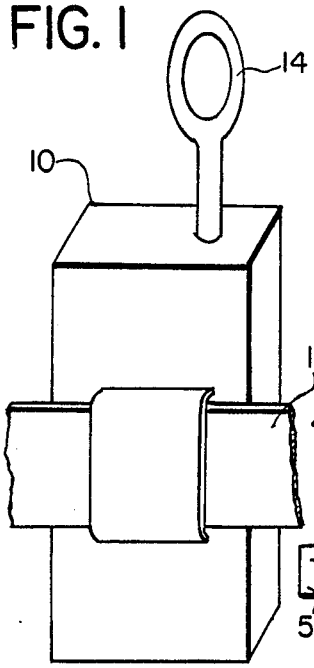
FIG. 1 is a fragmentary perspective view of a distress signal transmitter.

A signal transmitter 10 is worn by a swimmer or bather, for example, by means of a belt 12. Such transmitter 10 is provided with a switch handle 14 for operation by the swimmer in case of distress, such as a cramp of heart attack. Such signal is picked up by a suitably tuned receiver 16 which thereupon energizes the coil 18 of a relay 20 by way of a circuit 22 that is connected to a suitable electrical supply source 24. This causes relay contact switch 26 to close, thereby energizing net operating apparatus circuit 28.

Such circuit 28 includes a switch 30 which connects the circuit 28 to a source 32 of electrical power 34, and test switches 36 and 38 for checking the operation of the apparatus. Indicators 40 including lights, bells, and sirens and/or meters are connected in the circuit 28 for indicating that the apparatus is in operation.

Figure 2:
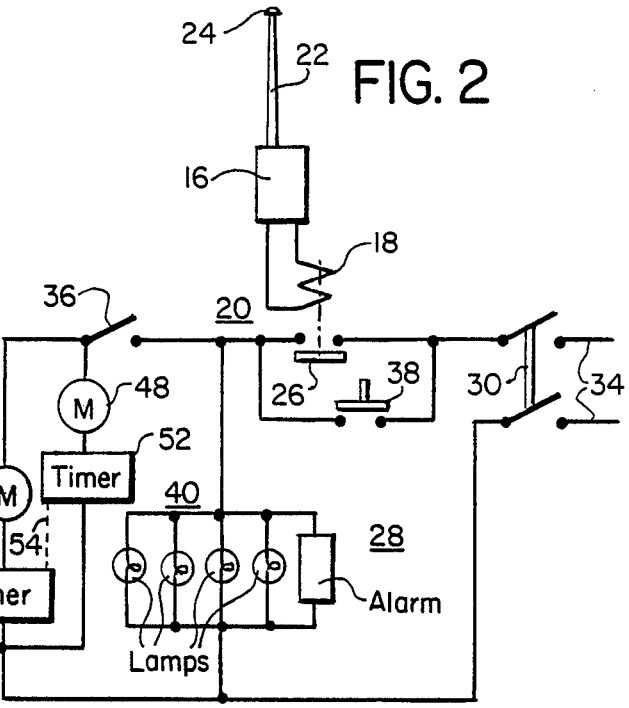
FIG. 2 is a circuit diagram of the signal receiving apparatus.
Figure 3:
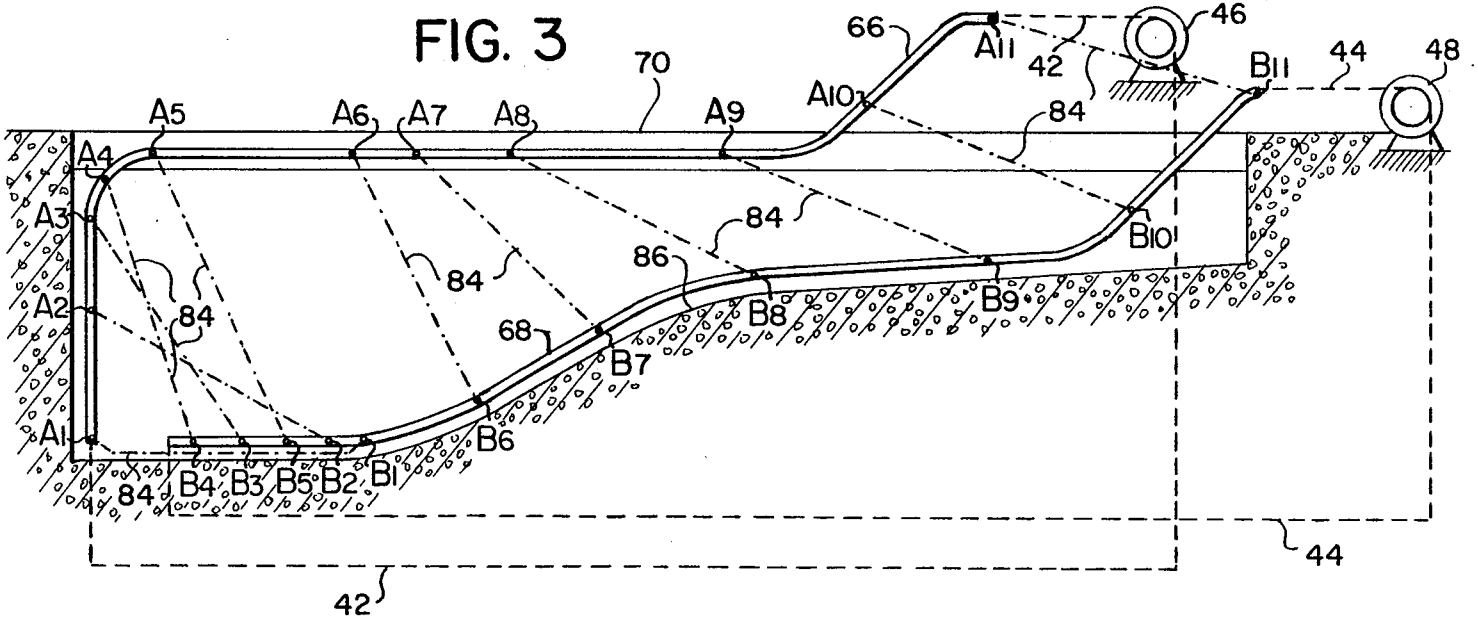
FIG. 3 is a view partly in section of a pool provided with a new drawing apparatus shown in side elevation.

FIG. 3 shows how the cables 42 and 44 are connected to motors 46 and 48 for timed movement as they are driven forwardly and backwardly, under the control of timers 50 and 52 in circuit 28, FIG. 2. The timers 50 and 52 are mechanically connected at 54.

Figure 7:
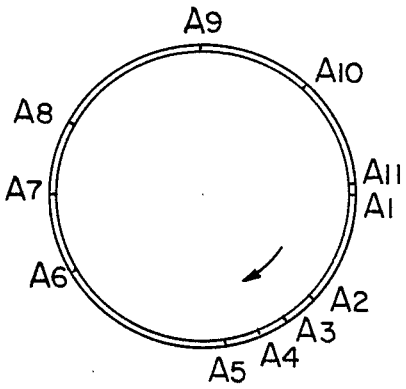
FIG. 7 is a diagrammatic view of a time cycle for drawing the outer edge of the net upwardly and downwardly, parallel to the deep end wall of the pool.
Figure 8:
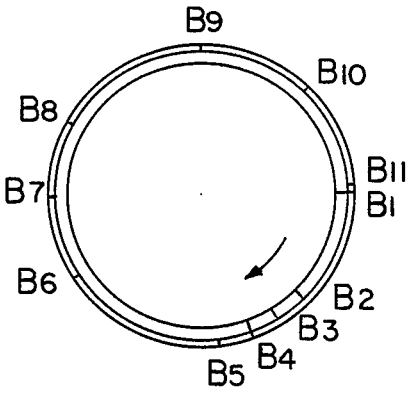
FIG. 8 is a similar view representing a time cycle controlling movement of the net backwardly as it is moved to draw an object from the pool, or automatically to place the net on the bottom thereof.
Figure 4:
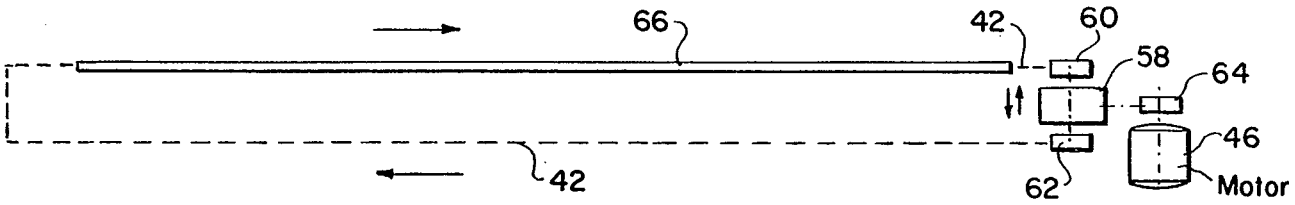
FIG. 4 is a schematic view of the net operating apparatus.

Referring to FIGS. 3, 7, and 8, the motors 46 and 48 are timed to move the upper cables 42 at a constant speed through forward increments $A_1$–$A_2$, $A_2$–$A_3$, etc., to $A_{10}$–$A_{11}$, while the lower cables 44 is moved first through reverse increments $B_1$–$B_4$, then at different forward speed increments $B_4$–$B_6$, $B_6$–$B_8$, and $B_8$–$B_{10}$. The forward constant speed of cables 42 is preferably two feet per second, while that of cables 44 is also two feet per second in moving through increments of $B_6$–$B_8$ and $B_8$–$B_{10}$. Reverse speed of cables 44 is 1.5 feet per second in increment $B_1$–$B_4$, while their forward speed through increment $B_6$–$B_8$ is four feet per second. This assures an untangled condition of the net as the object being recovered is drawn upwardly and above the pool. FIG. 4 shows how the upper cables 42, for example, is interconnected by a gear box 58 provided with cable pulleys 60 and 62. The gear box 58 is connected to a motor pulley 64. The cables 42 preferably are a flexible rod for movement through tracks 66 and 68 that are contoured to follow generally the adjacent surfaces of pool 70.

Figure 5:
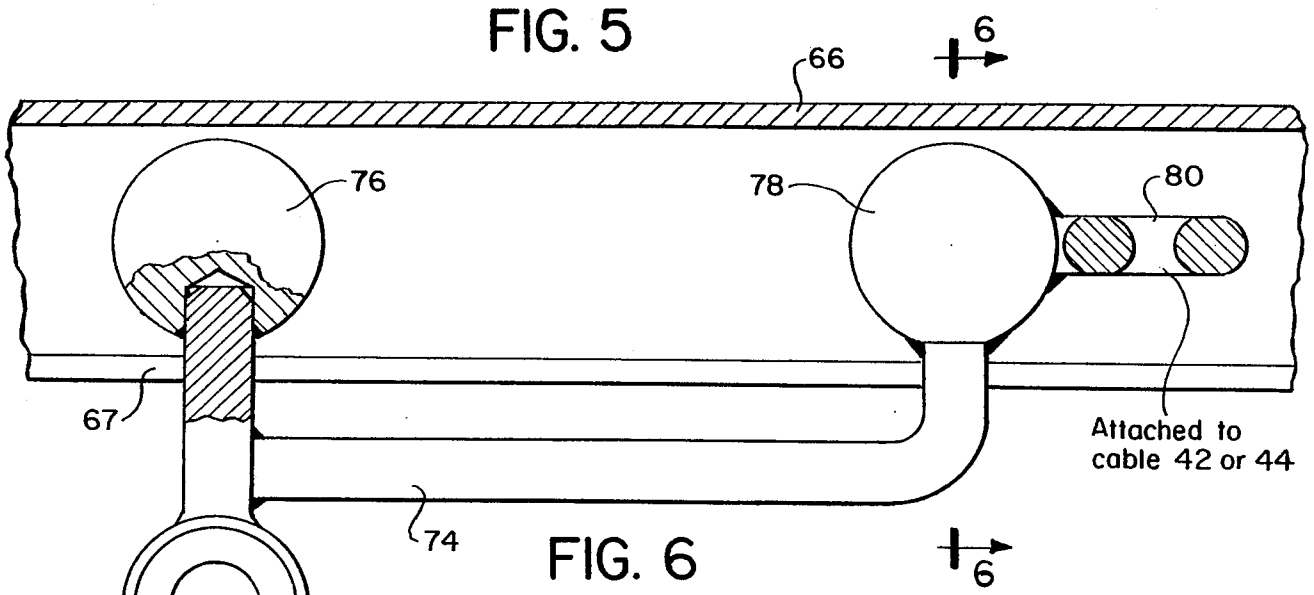
FIG. 5 is a view partly in side elevation and partly in cross section of a detail of a net control guide.
Figure 6:
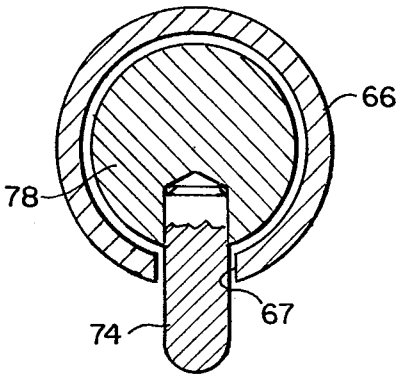
FIG. 6 is a cross sectional view of such guide taken on line A—A of FIG. 5.

A detail of one of the tracks 66 and 68, for example, is shown in FIGS. 5 and 6. The track 66 is a pipe provided with a longitudinal slot extending along the side thereof facing the center of the pool 70, FIG. 3, for movement of a guide 74 having balls 76, 78 located within the track 66. One ball 78 is connected at 80 to a cable, or flexible rod 42, for example. An eye 82 on the guide 74 is used to connect a corner of the net 84 to the guide 74. Thus, the submerged ends of the net are connected to upper and lower guides for controlling movement of the net for placement on the bottom 86 of pool 70, as well as for the recovery of an object or being to be removed from the pool by pulling up the net in a gentle, quick and automatic way.

The invention is suitable for removing fish as well as inanimate objects from a pool. In the case of children, the apparatus can remove a child that is in trouble by a simple action of operating the switch worn by the child, or by a switch under the control of a babysitter watching the child. In the case of adults in a pool, an adult can be saved by simply operating the switch or other signal generating device worn by such adult, or one within reach of a person outside of the pool.

While the invention has been described by reference to a particular embodiment, it will be clear to those skilled in the art that various modifications may be made thereto without departing from the spirit and scope of the invention as set forth in the appended claims.

I claim:

1. Pool recovery apparatus for automatically lifting a person or an object from the water in a swimming pool, which comprises:

a swimming pool with its bottom having a deep horizontally disposed portion at one end, a shallow horizontally disposed portion at its opposite end and a sloping center portion therebetween;

a flexible net, substantially rectangular in shape and dimensioned to cover generally said deep-end portion of said swimming pool bottom and normally to be positioned thereon, said net extending laterally from said wall to side wall of said pool and extending longitudinally from the end wall of said deep-end portion of said pool bottom to the point where said sloping center portion of said pool bottom starts upwardly and the pool depth begins to diminish;

automatic lifting means for raising said net from said deep-end portion of said pool bottom angularly through and out of the water to a position above and proximate said shallow end portion of said pool, thus accomplishing the desired recovery, said automatic lifting means comprising spaced parallel upper and lower tubular guide tracks, said tracks being located adjacent to, and extending along, the side walls of said multiple level swimming pool, said swimming pool extending from a deep depth to a shallow depth between said corresponding side walls, each of said upper and lower tubular tracks being provided with a guide, each of said guides being connected to one corner of said net, each of said parallel upper tracks being contoured to follow along each upper side edge of said pool, downwardly adjacent and along said deep-end end wall and upwardly above said opposite shallow end of said pool, so that said guides, when pulled by said automatic lifting means, follow said guide tracks and slidably carry said corners of the deep-end edge of said net, held by said guides in said upper tracks, upwardly, then horizontally and finally upwardly above said shallow end of said pool;

means for producing a signal to cause said automatic lifting means to move said net through, above and from the water in said swimming pool; and means for energizing said automatic lifting means in response to said signal.

2. Pool recovery apparatus as defined in claim 1, in which the signal producing means is a portable signal transmitter, and said energizing means includes a signal receiver having a circuit that is responsive to said signal.

3. Pool recovery apparatus as defined by claim 2, wherein:

a person in a the swimming pool requires rescue; and said signal producing means is said transmitter worn by the person in said pool, whereby the activation of said transmitter by the person results in the automatic rescue of the person by the pool recovery apparatus.

4. Pool recovery apparatus as defined in claim 1, further comprising:

each of said lower tracks extending parallelly along one said pool side wall and generally following the contour of said pool bottom, with the lower end of each of said lower tracks terminating short of said deep-end end wall of said pool, the upper end of each of said lower tracks being angled above the water in said pool at its shallow end; and means for moving said guides in said lower tracks in such a programmed way that as said guides pull the lower corresponding end edge of said net normally resting on said pool bottom, said corresponding end edge of said net is moved first toward said deep end of said pool, then toward said shallow end, and finally upwardly with the object being recovered on said net, said net being kept untangled at all times as it is lifting said object gently but quickly out of the water in said pool.

5. Pool recovery apparatus as defined by claim 4, further comprising timing means provided for controlling the return movement of said guides and said edges of said net back into starting place on said pool bottom at relative speeds such that said net remains untangled and is re-positioned to repeat its upward recovery movement when the pool recovery apparatus is energized.

6. Pool recovery apparatus as defined by claim 5, in which said automatic lifting means further comprising:

a plurality of motors, one for each of said guide tracks, operatively connected to and for moving said net-attached guides;

flexible cables operatively connecting said guides and said motors, said cables extending within and through each of said tubular guide tracks; and an electrical control circuit for energizing said motors, comprising:

a switch operatively connecting said motors to a source of electrical supply;

indicators including lamps and alarms located outside the pool; and test switches for checking the operation of said circuit and said motors.

7. Pool recovery apparatus as defined by claim 6, in which said automatic lifting means further comprises:

said upper tubular guide tracks having vertical reaches near said deep end wall of said pool, longitudinal reaches adjacent the top of each said side wall of said pool and upwardly arched reaches extending above said shallow end of said pool;

said lower tubular guide tracks having reaches in general following the contour of said pool bottom, and reaches arched above said shallow end of said pool, the lower ends of said lower tracks being spaced from the corresponding ends of said upper tracks by a distance corresponding to the length of said net, thus leaving an area of said pool bottom therebetween on which said net normally rests deployed in flat untangled condition;

said guide tracks consisting of hollow pipes having longitudinal slots extending along the entire length of said tracks, said longitudinal slots facing inwardly toward the center of said pool;

said guides being carried by said tracks being connected to said end corners of said net, said guides comprising balls free to be moved slidably in and along said pipe tracks;

said flexible cables in said pipe tracks being connected to, and for moving, said guides, said cables extending outside and beyond the upper ends of said pipe tracks;

cable reels driven by said motors for winding thereon and unwinding therefrom said cables, thus moving said cables and said guides attached thereto in their respective said pipe tracks, and thus moving said net in its prescribed path in both rescue and return directions; and electrical control circuit for energizing said motors and said motor-driven reels, which comprises:

timing means for controlling the movements of said upper and said lower cable so that said net is drawn upwardly through the water in said pool in the direction of said pool's shallow end without becoming entangled; and a switch for starting and providing power to the automatic rescue operation for energizing said motors and means for continuing said operation until the object, such as a person, is automatically rescued from said pool by said net as said net first lifts the object and gently moves it toward said shallow end of, and finally entirely out of, said pool.

* * * * *